US010251456B2

(12) United States Patent
Heinz

(10) Patent No.: US 10,251,456 B2
(45) Date of Patent: Apr. 9, 2019

(54) ANNULAR PIECE OF JEWELRY HAVING MOVABLE COAXIAL RING ELEMENTS

(71) Applicant: Jörg Heinz GmbH & Co. KG, Neulingen (DE)

(72) Inventor: Martin Heinz, Neulingen (DE)

(73) Assignee: JÖRG HEINZ GMBH & CO., KG, Neulingen (DE)

( * ) Notice: Subject to any disclaimer, the term of this patent is extended or adjusted under 35 U.S.C. 154(b) by 469 days.

(21) Appl. No.: 14/792,095

(22) Filed: Jul. 6, 2015

(65) Prior Publication Data

US 2016/0037882 A1 Feb. 11, 2016

Related U.S. Application Data

(63) Continuation of application No. PCT/EP2014/000066, filed on Jan. 14, 2014.

(30) Foreign Application Priority Data

Jan. 14, 2013 (DE) ..... 10 2013 000 436
Jan. 14, 2013 (DE) ..... 20 2013 000 291 U

(51) Int. Cl.
*A44C 9/00* (2006.01)

(52) U.S. Cl.
CPC ..... *A44C 9/003* (2013.01); *A44C 9/0007* (2013.01); *A44C 9/0015* (2013.01)

(58) Field of Classification Search
CPC ... A44C 9/0007; A44C 9/0015; A44C 9/0023; A44C 9/003; A44C 9/00
See application file for complete search history.

(56) References Cited

U.S. PATENT DOCUMENTS

| | | | | |
|---|---|---|---|---|
| 1,327,606 | A * | 1/1920 | Bacharach | A44C 9/003 29/896.412 |
| 5,228,316 | A * | 7/1993 | Meyrowitz | A44C 17/0258 63/15.4 |
| 5,483,808 | A | 1/1996 | Barbazza | |
| 2008/0006055 | A1* | 1/2008 | Silvant | A44C 9/003 63/10 |
| 2017/0035161 | A1* | 2/2017 | Malo | A44C 9/003 |

FOREIGN PATENT DOCUMENTS

| | | |
|---|---|---|
| DE | 42 10 982 A1 | 10/1993 |
| DE | 201 11 802 U1 | 10/2001 |
| EP | 2 491 808 A2 | 8/2012 |

* cited by examiner

*Primary Examiner* — Emily M Morgan
(74) *Attorney, Agent, or Firm* — Hackler Daghighian Martino & Novak

(57) ABSTRACT

An annular piece of jewelry includes a plurality of coaxial ring elements connected to each other and moveable in relation to each other, where the ring elements include an inner ring element and two outer ring elements wherein the inner ring element and the outer ring elements can be moved in relation to each other into various positions. The outer ring elements cover different outer circumference surface regions of the inner ring element. The inner ring element is arranged in an axial direction between the two outer ring elements or between parts of the outer ring elements. The two outer ring elements and the inner ring element are coupled to each other in such a manner that the inner ring element can be moved in axial direction by rotating one of the two outer ring elements in relation to the other one of the two outer ring elements.

16 Claims, 11 Drawing Sheets

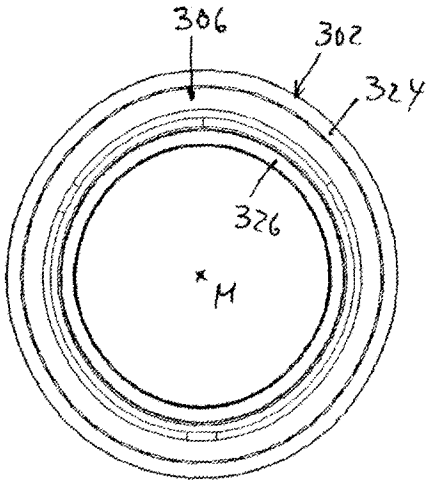
Fig. 18a
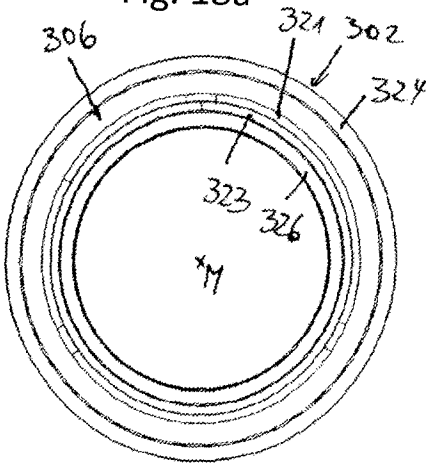
Fig. 18b
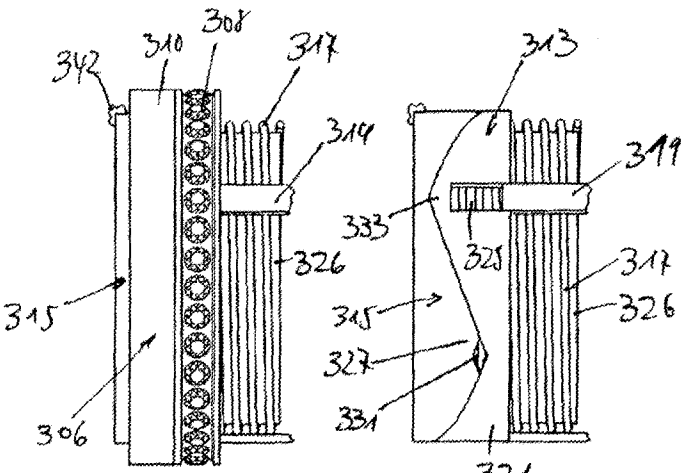
Fig. 16a
Fig. 16b
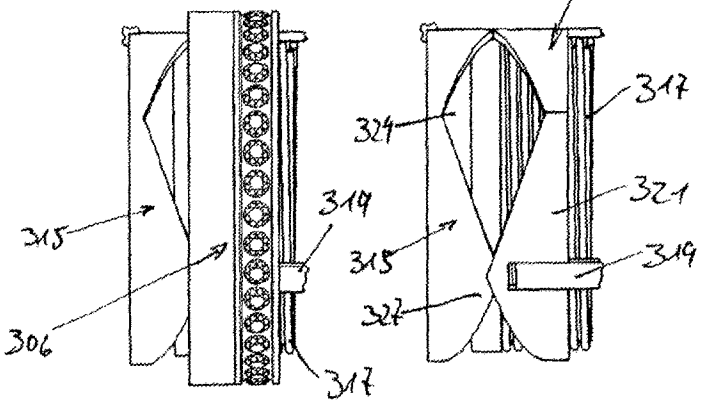
Fig. 17a
Fig. 17b

ANNULAR PIECE OF JEWELRY HAVING MOVABLE COAXIAL RING ELEMENTS

CROSS-REFERENCE TO RELATED APPLICATIONS

This continuation application claims priority to PCT/EP2014/000066 filed on Jan. 14, 2014 which has published as WO 2014/108343 A1 and also the German application number 10 2013 000 436.5 filed on Jan. 14, 2013 and German application number 20 2013 000 291.3 filed on Jan. 14, 2013, the entire contents of which all applications are fully incorporated herein with these references.

DESCRIPTION

Field of the Invention

The invention relates to an annular piece of jewelry with a versatile appearance, particularly a ring.

Background of the Invention

The piece of jewelry is made of a plurality of coaxial ring elements which are connected to each other and can be moved in relation to each other, wherein the ring elements comprise at least one inner ring element and two outer ring elements and wherein the inner ring element and the outer ring elements can be moved in relation to each other into various positions to change the appearance of the piece of jewelry, where the outer ring elements respectively cover different outer circumferential surface regions of the inner ring elements.

Annular pieces of jewelry with only two coaxial ring elements which can be moved in relation to each other in various positions, where the outer ring element covers different outer circumferential surface regions of the inner ring element and therefore leads to various appearances of the piece of jewelry, are known from DE 201 11 802 U1 and U.S. Pat. No. 5,483,808.

The piece of jewelry known from DE 201 11 802 U1 shows an inner ring element with a smaller inner diameter than the outer ring element, so that after putting the piece of jewelry on a body part, for example a finger in case of a ring, only the inner ring element is supported on the body part. Thus the outer ring element can be moved into various positions in relation to the inner ring element without taking off the piece of jewelry. However, it is considered as disadvantageous that on one front face of the piece of jewelry an axial direction open gap is formed between the outer ring element and the body part, in which dirt can easily accumulate.

For the piece of jewelry known from U.S. Pat. No. 5,483,808 the outer ring element shows at one front face a collar projecting to the inside, its inner diameter corresponding to the inner diameter of the inner ring element, so that, after putting the piece of jewelry on a body part, both the outer ring element and the inner ring element are supported on the body part. However, in that case a gap is formed between the inner side of the collar and the opposing front face of the inner ring element which is open to the inside in radial direction, which width decreases if the inner ring element is moved further into the outer ring element. To avoid a painful clamping of parts of the body part in the gap, the piece of jewelry must be taken off before undertaking an adjustment of the two ring elements.

Another disadvantage of the aforementioned pieces of jewelry in aesthetic regards is that they cannot be developed mirror-symmetrically to a middle plane vertical to a length axis of the body part, which is especially desired by many customers for rings.

DE 42 10 982 A1 discloses a similar piece of jewelry, too, also having the danger of clamping parts of the body part in a gap being open to the inside between an annular outer part and an annular inner part, if both parts are moved to each other without taking off the piece of jewelry. DE 42 10 982 A1 further discloses a piece of jewelry of the mentioned kind, since many variations of possibilities should exist, if several outer parts exist which are relocatable on the inner part independently from each other like on an axis and as well cover optionally various parts of the outer wall of the inner part.

Based on this, the invention has the object to create an annular piece of jewelry of the aforementioned kind having a versatile appearance, where the ring elements are movable on a body part in relation to each other without dirt that can intrude between the ring elements and the body part, and preferably without the danger of clamping parts of the body part.

SUMMARY OF THE INVENTION

This object is solved according to the invention by arranging the inner ring element in axial direction between the two outer ring elements or between parts of the outer ring elements.

This feature enables arranging the outer ring elements on the opposing front faces of the piece of jewelry and measure them in a way so that they embrace the body part tightly, which prohibits intrusion of dirt between the piece of jewelry and the body part.

For this purpose advantageously the inner cross section or inner diameter of the outer ring elements or of parts of the outer ring elements is smaller than the inner cross section or inner diameter of the inner ring element.

A particularly preferred embodiment of the invention provides that a spacer is located radially inward from the inner ring element, which holds both outer ring elements in relation to each other in a predefined axial position. In this way it is achieved that only the inner ring element is moving in axial direction of the body part when the ring elements are moved into another position on the body part in relation to each other, so that an axial movement of the two outer ring elements is avoided. Moreover the spacer arranged radially inwards from the inner ring element can be easily formed in a way that it prevents clamping of parts of the body part between the inner ring element and the outer ring element if the inner ring element is moved axially.

The spacer can either be formed by an additional spacing element which is inserted between parts of the two outer ring elements, preferably inner circumferential segments, and keeps a predefined space between the two outer ring elements, or it can be formed by parts, preferably inner circumferential segments, of the two outer ring elements, which fit against each other with two opposite front faces and hold the two outer ring elements in the predefined axial position.

A preferred embodiment of the invention provides that the spacer is shaped tubular or sleeve-like and preferably has a body-part-fitting inner side, so that the piece of jewelry not only rests on the body part on the front faces but also, radially inwards, on the spacer. To enhance the wearing comfort of the piece of jewelry on a body part, especially in case of a ring, the inside of the spacer forms advantageously a coaxial, smooth, generally cylindrical contact surface for the body part in relation to the two outer ring elements and the inner ring element, which inner diameter is practicably smaller than the inner diameter of the ring element arranged radially outward from the spacer and corresponds to the inner diameter of the entire piece of jewelry or the inner diameter of the two outer ring elements on the opposing front faces of the piece of jewelry.

Another especially preferred embodiment of the invention provides that the two outer ring elements are coupled via the inner ring element, preferably such that the inner ring element can be moved in axial direction by rotating one of the two outer ring elements in relation to the other outer ring element. In the course of the axial movement of the inner ring element different parts of the inner ring element are covered by the two outer ring elements, which maintain their axial positions during axial movement of the inner ring element. Thereby the appearance of the piece of jewelry in a state where it is located on a body part can be varied by solely rotating one of the two outer ring elements around the longitudinal axis of the body part.

To achieve this, the inner ring element is axially movable in relation to the two outer ring elements, but can only be rotated according to an advantageous variant of the invention only in relation to one of the two outer ring elements, while it is fixed to the other of the two outer ring elements. According to another variant of the invention it can be provided that the axial movement of the inner ring element is correlated to a rotation of two parts of the inner ring element in relation to each other.

Another preferred embodiment of the invention provides that the inner ring element has at least two parts which are preferably exchangeable, so that the design of the inner ring element can be varied in many cases by a choice of different parts and the aforementioned relative rotation of two parts of the inner ring element is enabled.

Advantageously the inner ring element is held in two end positions in a force-fitting manner, so that it cannot move easily out of the end positions, but only with a deliberate rotation of the two outer ring elements in relation to each other.

The coupling between the ring elements can be carried out according to a first advantageous variant of the invention by at least one additional annular or sleeve-like guiding element, arranged in radial direction inwards from the inner ring element, having a guidance, in which at least one guiding pin is movably guided, which can be fixedly connected to one of the outer ring elements or the inner ring element. Advantageously, there are provided two annular or sleeve-like guiding elements with different guidances, whereas the at least one guiding pin extends through the guidance of the one guiding element and projects with its free end into the guidance of the other guiding element.

Alternatively the coupling of the inner ring element and the outer ring element according to a second advantageous variant of the invention can also be achieved by a toothed ring element arranged in a radial direction inwardly of the inner ring element and having a face toothing, which engages a face toothing of an opposite toothed ring element, whereby the inner ring element is fixedly connected with one of the two toothed ring elements, whereas one of the two toothed ring elements can be rotated by rotating the two outer ring elements in opposite relation to each other in relation to the other toothed ring element, and whereas this rotation causes an axial movement of the toothed ring element which is connected to the inner ring element. In this variant of the invention the piece of jewelry comprises advantageously a spring, which counteracts the axial movement of the toothed ring element connected to the inner ring element in one direction.

A third advantageous variant of the invention provides that the inner ring element is connected to both outer ring elements through pivotable coupling members, which are pivoted during a movement of the inner ring element in relation to the outer ring elements towards both the inner ring element and the outer ring element.

BRIEF DESCRIPTION OF THE DRAWINGS

In the following, the invention will be described in more detail by two embodiments shown in the figures:

FIGS. 16*a* and 16*b* show parts of the piece of jewelry from FIG. 15 in partially mounted state in the first position of the inner ring element;

FIGS. 17*a* and 17*b* show parts of the piece of jewelry from FIG. 15 in partially mounted state in the second position of the inner ring element;

FIG. 18*a* shows a cross-sectional view of the piece of jewelry in the first position of the inner ring element;

FIG. 18*b* shows a cross-sectional view of the piece of jewelry in the second position of the inner ring element;

DETAILED DESCRIPTION OF THE PREFERRED EMBODIMENTS

Figure 1A:
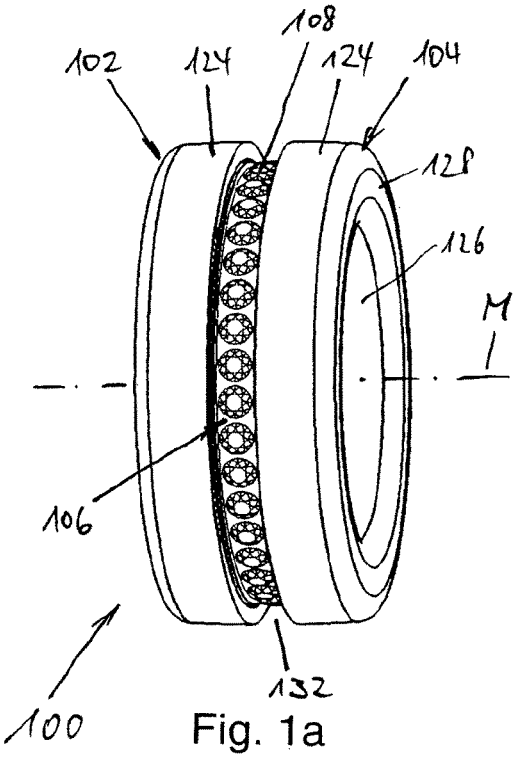
FIGS. 1*a* and 1*b* show perspective views of a first embodiment of a piece of jewelry according to the invention with versatile appearance in form of a ring in a first and in a second position of the inner ring element.
Figure 1B:
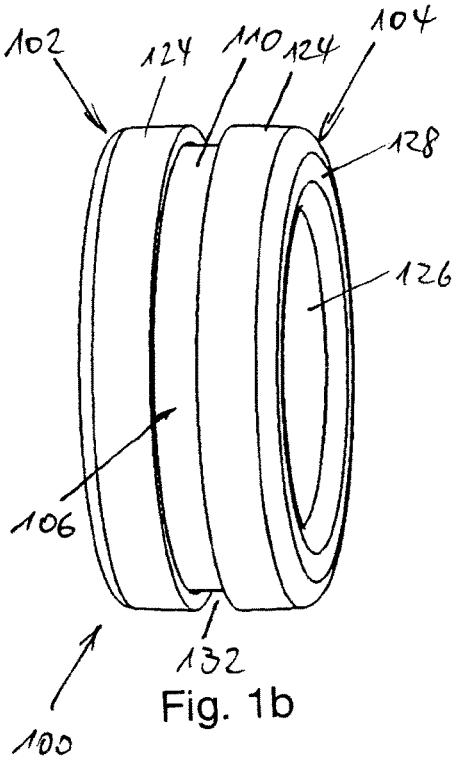

The pieces of jewelry 100; 200; 300; 400 depicted in the figures in form of a ring can be altered in their appearances, as shown as in FIG. 1*a* and 1*b*, FIGS. 2*a* and 2*b* and FIGS. 9*a* and 9*b*, without taking off the ring on the finger from its place. The appearance of the ring can also be altered if taken off from the finger. Dismantling of parts from the ring to change its appearance is not required.

The depicted rings 100; 200; 300; 400 comprise two outer ring elements 102, 104; 202, 204; 302, 304; 402; 404 respectively, which are arranged on the front faces of the rings 100; 200; 300; 400 as well as a dyadic inner ring element 106; 206; 306; 406 which is arranged in direction of a middle axis M of the rings 100; 200; 300; 400 between the two outer ring elements 102, 104; 202, 204; 302, 304; 402, 404. These three ring elements 102, 104, 106; 202, 204, 206; 302, 304, 306; 403, 404, 406 are arranged coaxial in relation to the middle axis M. The inner ring element 106; 206; 306; 406 can be moved between the two outer ring elements 102, 104; 202, 204; 302, 304; 402, 404 in the direction of the middle axis M into two different end- or displacement positions, where one of the two outer ring elements 102, 104; 202, 204; 302, 304; 402, 404 covers the inner ring element 106; 206; 306; 406 along half of its length respectively, so that only one half is visible. The inner ring element 106; 206; 306; 406 consists of two separate halves 108, 110; 208, 210; 308, 310; 408, 410 respectively, with their respective outer circumference designed differently. The two halves 108, 110; 208, 210; 308, 310; 408, 410 of the inner ring element 106; 206; 306, 406 which are arranged one after the other in direction of the middle axis M are individually exchangeable and are, apart from their outer circumference, identically, so that a customer is able to choose both halves 108, 110; 208, 210; 308, 310; 408, 410 to his liking from a variety of options and insert them into the rings 100; 200; 300; 400.

In the depicted rings 100; 200, 300; 400 one of the two halves 110; 210; 310; 410 shows a smooth metallic surface extending along its outer circumference, while the other half 108; 208; 308; 408 is encrusted with polished jewel stones or gemstones extending along its whole circumference. However, there is a large number of possible other designs, for example designs where at least one of the halves 108, 110; 208, 210; 308, 310; 408, 410 is provided with patterns or engravings extending along its circumference or consists of metals, especially precious metals, in various colors.

In the depicted rings 100; 200; 300; 400 the two outer ring elements 102, 104; 202, 204; 302, 304; 402, 404 are coupled in such a manner, that the inner ring element 106; 206; 306; 406 can be moved from each of the two end- or displacement positions to the respective other end- or displacement position by rotating one of the two outer ring elements 102, 104; 202, 204; 302, 304; 402, 404 by a predetermined angle around the ring axis M in relation to the other one of the two outer ring elements 102, 104; 202, 204; 302, 304; 402, 404.

For the rings 100; 200; 300, depicted in the FIGS. 1 to 7, 8 to 13 and 15 to 17, the rotation of one of the two outer ring elements 102, 104; 202, 204; 302, 304 in relation to the other results in that the inner ring element 106; 206; 306; 406 is maintaining its rotary position around the ring axis M in relation to one of the outer ring elements 102, 104; 202, 204; 302, 304, while it changes its rotary position in relation to the other one of the outer ring elements 102, 104; 202; 204; 302, 304 according to the rotation. Whereas in the ring 400 depicted in FIGS. 18 to 21 a rotation of one of the two outer ring elements 402, 404 leads to a change of the rotary position of the two halves 408, 410 of the inner ring element 406 in relation to each other.

During the rotation of one of the outer ring elements 102, 104; 202, 204; 302, 304; 402, 404 and during the thus caused axial movement of the inner ring element 106; 206; 306; 406 respectively the distance and the position of the two outer ring elements 102, 104; 202, 204; 302, 304; 402, 404 respectively in relation to each other in direction of the ring axis M does not change for all rings 100; 200; 300; 400, as best seen by a comparison of the FIGS. 2*a* and 2*b*, 9*a* and 9*b*.

The constant axial distance of the two outer ring elements 102, 104; 202, 204; 302, 304; 402, 404 is achieved for all rings 100; 200; 300; 400 such that between the two outer ring elements 102, 104; 202, 204; 302, 304; 402, 404 not only the inner ring element 106; 206; 306; 406 is arranged, but also a spacer 112; 212; 312; 412 is arranged radially inward from the inner ring element 106; 206; 306; 406 which provides that the axial length of the rings 100; 200; 300; 400 stays constant and does not change during a movement of the inner ring element 106; 206; 306; 406. The spacer 112; 212; 312; 412 has an annular or sleeve-like shape and separates the inner ring element 106; 206; 306; 406 from the finger on which the ring 100; 200; 300; 400 is worn, by which clamping of parts of the finger during an adjustment of the inner ring element 106; 206; 306; 406 is prevented.

Figure 2A:
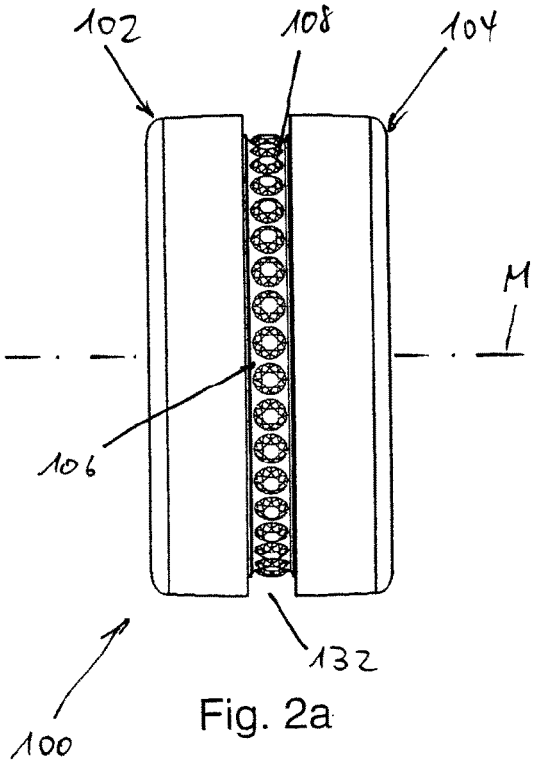
FIGS. 2*a* and 2*b* show side views of the piece of jewelry in a first and a second position of the inner ring element.
Figure 2B:
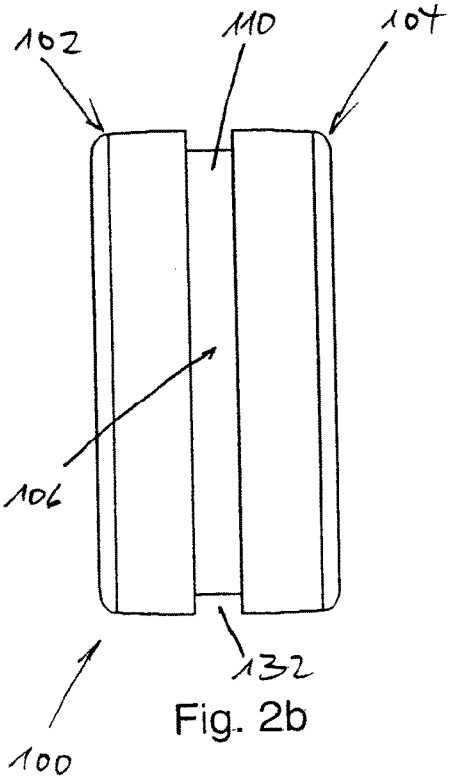
Figure 3:
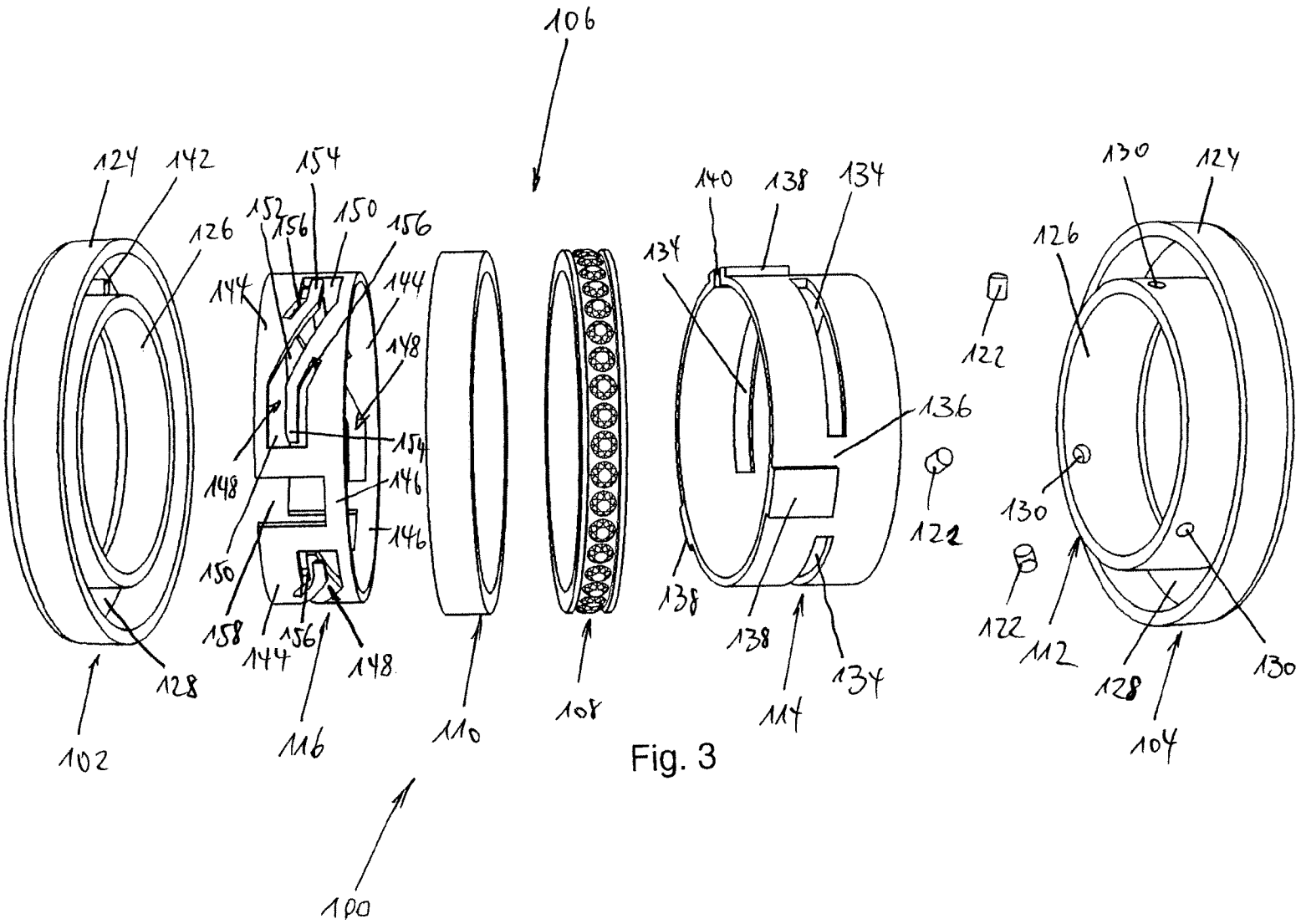
FIG. 3 shows an exploded perspective view of the parts of the piece of jewelry.

As best seen in FIG. 3, the ring 100 depicted in FIGS. 1 to 7 consists mainly of the two outer ring elements 102, 104, the inner ring element 106 consisting of the two halves 108, 110 as well as of a first and a second sleeve-like guiding element 114, 116, each having a guidance for three guiding pins 122 respectively.

The two outer ring elements 102, 104 being generally rotationally symmetrical to the ring axis M are formed in one piece, respectively, each consisting of a hollow cylindrical outer circumferential segment 124, a hollow cylindrical inner circumferential segment 126, and an annular bottom segment 128 arranged between the circumferential segments 124, 126, the bottom segment being connected to the two circumferential segments 124, 126 by rounded transitions forming respective front faces of the ring 100. In the planes defined by the ring axis M the outer ring elements 102, 104 have got a groove-like cross section form. For the ring element 102 the inner circumferential segment 126 has the same axial length as the outer circumferential segment 124, while for the other ring element 104 it is half of the width of the inner ring element 106 longer than the outer circumferential segment 124 and is provided in the protruding part with three radial bores 130. By the before mentioned length dimensions it is achieved that the inner circumferential segments 126 of the two ring elements 102, 104, after mounting of the ring 100, lie against each other with their opposing front faces and form the annular or sleeve-like spacer 112, which provides a constant axial length of the ring 100. On the other hand, after mounting the ring 100, a radial outwards open gap 132 is formed between the two outer circumferential segments 124, with its width corresponding to half of the width of the inner ring element 106, so that in every final position of the inner ring element 106 only one of its halves 108, 110 is visible through the gap 132, as best seen in FIGS. 1 and 2. The two inner circumferential segments 126, however, are not connected to each other, so that the two outer ring elements 102, 104, after mounting the ring 100, can be rotated against each other around the ring axis M.

The smooth cylindrical inside of the inner circumferential segments 126 of the ring elements 102, 104 forms the contact surface, with which the ring 100 touches the finger when worn.

The first sleeve-like or hollow cylindrical guiding element 114 has an inner diameter, which corresponds to the outer diameter of the inner circumferential segment 102 of the outer ring element 102 and is slightly larger than the outer diameter of the inner circumferential segment 126 of the outer ring element 104, so that the guiding element 114 when mounting the ring 110 can be slid axially on the two circumferential segments 126 and is held by the hollow cylindrical spacer 112 between the two outer ring elements 102, 104. The guiding element 114 is fixedly connected to the outer ring element 102, while it is rotatable in relation to the other outer ring element 104 around the ring axis M. For the first guiding element 114 the guidance consists of three guiding slits 134 running in the middle of the guiding element 114 in its circumferential direction, which span over a circumferential angle of approximately 90 to 100 degrees and are separated from each other through material bridges 136. In the area of the material bridges 136 the guiding element 114 shows an outwardly protruding flat projecting piece 138 with a constant radial height and a rectangular profile, which is adjacent to the outer ring element's 102 adjacent front face of the guiding element 114. In the area of one of three projecting pieces 138 (in FIG. 3 at the top) the guiding element 114 has a gap 140, which is one-sided open to this front face. The gap 140 is used for receiving a nose 142 which projects inwards over the bottom segment 128 of the ring element 102, which works in gap 140 as twist lock when the guiding element 114 is inserted onto circumferential segment 126 of the ring element 102 and is fixedly connected to the outer ring element 102, for example, by laser welding.

The second sleeve-like or hollow cylindrical guiding element 116 has a width which corresponds to the width of the inner ring element 106, an outside diameter which corresponds to the inner diameter of the inner ring element 106 and an inner diameter which corresponds to the outside diameter of the first guiding element 114. The second guiding element 116 has three circumferential segments 144, which span over a circumferential angle of approximately 110 degrees and are separated from each other by narrow material bridges 146. For guiding element 116 the guidance consists of three slit-like openings 148, each being arranged in one of the three circumferential segments 144 respectively. Each opening 148 comprises two straight segments 150 extending in circumferential direction and one diagonally extending segment 152 arranged in between. The two extending segments 150 in circumferential direction are confined at one side by an elongated latch 154, which spans parallel to the opening 148 and is separated by a narrow, to the end of the segment 150 open slit 156 from the rest of the guiding element 116. The free end of the latch 154 is slightly bent towards the adjacent segment 150 of the opening 148, so that it has a slightly smaller width at its end for an unloaded latch 154. In the area of the material bridges 146 the guiding element 116 has respectively a rectangular notch 158 which is open towards the outer ring element 102 at its rim, whereas the positions and measurements of the notches 158 corresponds to the positions and measurements of the protrusions 138 of the first guiding element 114.

Figure 4A:
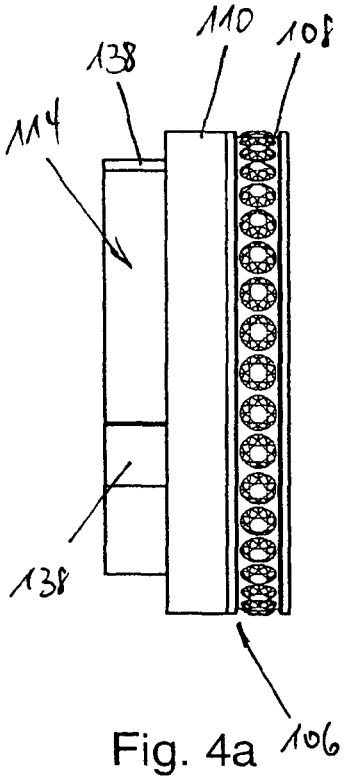
FIGS. 4*a* and 4*b* show parts of the piece of jewelry in partially mounted state in the first position of the inner ring element.
Figure 4B:
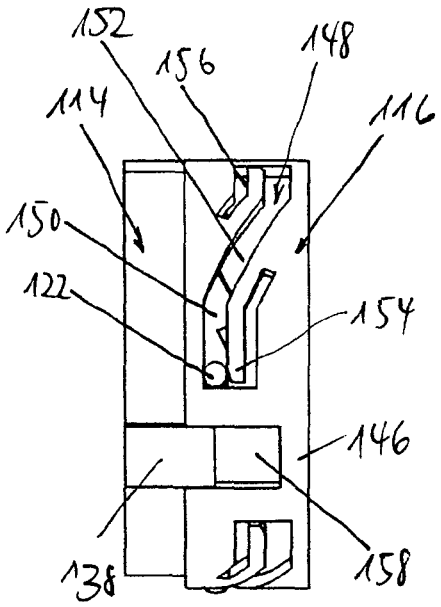
Figure 5A:
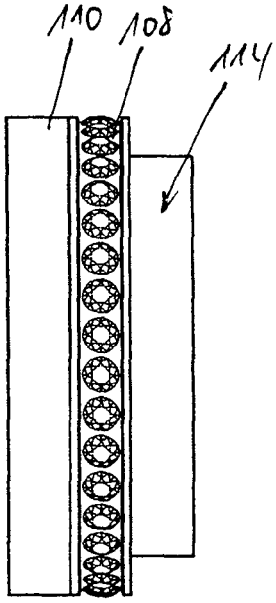
FIGS. 5*a* and 5*b* show parts of the piece of jewelry in partially mounted state in the second position of the inner ring element.
Figure 5B:
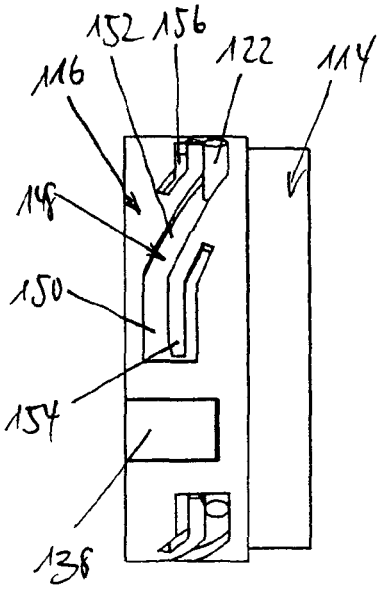
Figure 6A:
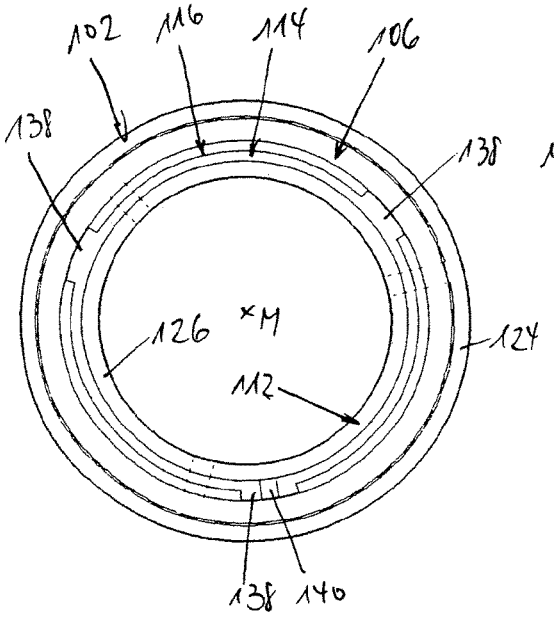
FIG. 6*a* shows a cross-sectional view of the piece of jewelry in the first position of the inner ring element.
Figure 6B:
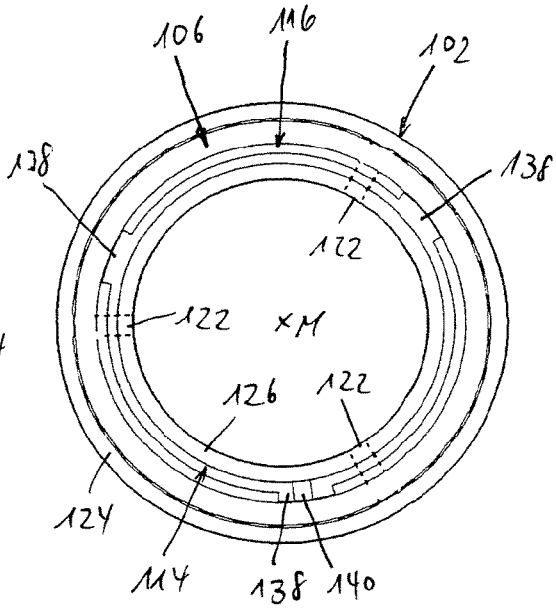
FIG. 6*b* shows a cross-sectional view of the piece of jewelry in the second position of the inner ring element.
Figure 7:
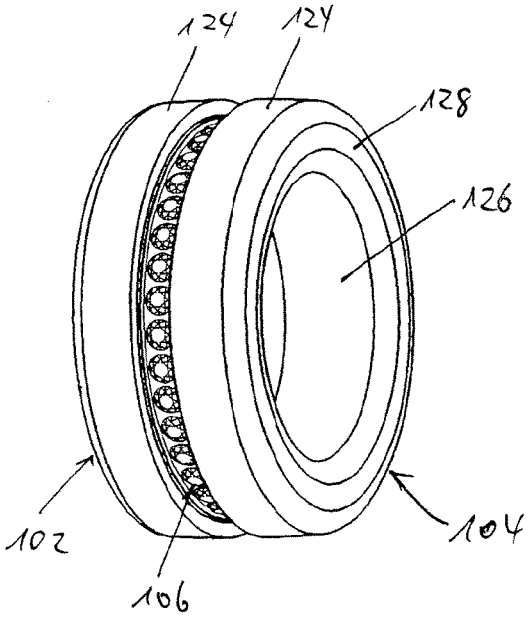
FIG. 7 shows another perspective view of the piece of jewelry after the mounting of the parts.

Due to the dimensions of the second guiding element 116 the two halves 108, 110 of the inner ring element 106 can be, when assembling the ring 100, arranged onto the guiding element 116 until it is entirely covered. Afterward the two halves 108, 110 of the inner ring element 106 are being fixedly connected, for example by laser welding or soldering, to the second guiding element 116, which is then located radially inwards from the inner ring element 106. After that the second guiding element 116 is arranged onto the first guiding element 114, which before was fixedly connected to the outer ring element 102. In doing so, the protrusions 138 are inserted into the notches 158, as best seen in FIGS. 4*b* and 5*b*.

In this state the second guiding element 116 and therefore also the inner ring element 106 connected to the second guiding element 116 can only move in the direction of the ring axis M on the first guiding element 114, but cannot rotate around the ring axis M, because this is prevented by protrusions 138 engaging the notches 158.

Afterward the outer ring element 104 is installed, by inserting its inner circumferential segment 126, until abutting in against the circumferential segment 126 of the outer ring element 102, into the inside of the first guiding element 114. Then the pins 122 are inserted from the inside of the circumferential segment 126 of the outer ring element 104 into the bores 130, until they project from the inside through the guiding slits 134 of the guiding element 114 into the opening 148 of the guiding element 116, as shown in FIGS. 4*b* and 5*b*. Finally, the pins 122 are fixed in the bores 130 of the outer ring element 104, so that also the two ring elements 102, 104 are held together axially immobile, because the pins 122 are fixedly connected to the outer ring element 104 and extend into guiding slits 134 running only in circumferential direction of the first guiding element 114, which is fixedly connected to the other outer ring element 102.

To change the appearance of the completely assembled ring 100 the inner ring element 106 can be moved between the two final positions shown in FIGS. 2*a* and 2*b*, in which only one half 108 or 110 of the inner ring element 106 is visible through the gap 132 between the outer circumferential segments 124 of the two outer ring elements 102, 104. For that purpose, the one outer ring element 104 is rotated in relation to the other outer ring element 102 by an angle of approximately 90 to 110 degrees. By doing so the pins 122 move well along the guiding slits 134 of the first guiding element 114 as well as along the openings 148 of the second guiding element 116. If the inner ends of the pins 122 move through the slanted segments 152 of the openings 148, the second guiding element 116 is moved together with the inner ring element 106 on the first guiding element 114 in axial direction into the other final position, respectively. The inner ring element 106 rotates in relation to the outer ring element 102, but not in relation to the outer ring element 104. In the two final positions the pins 122 are clamped in a force-fitting manner by the elastic preloaded flexible latches 154, so that the inner ring element 106 cannot leave the two final positions by itself.

Figure 8:
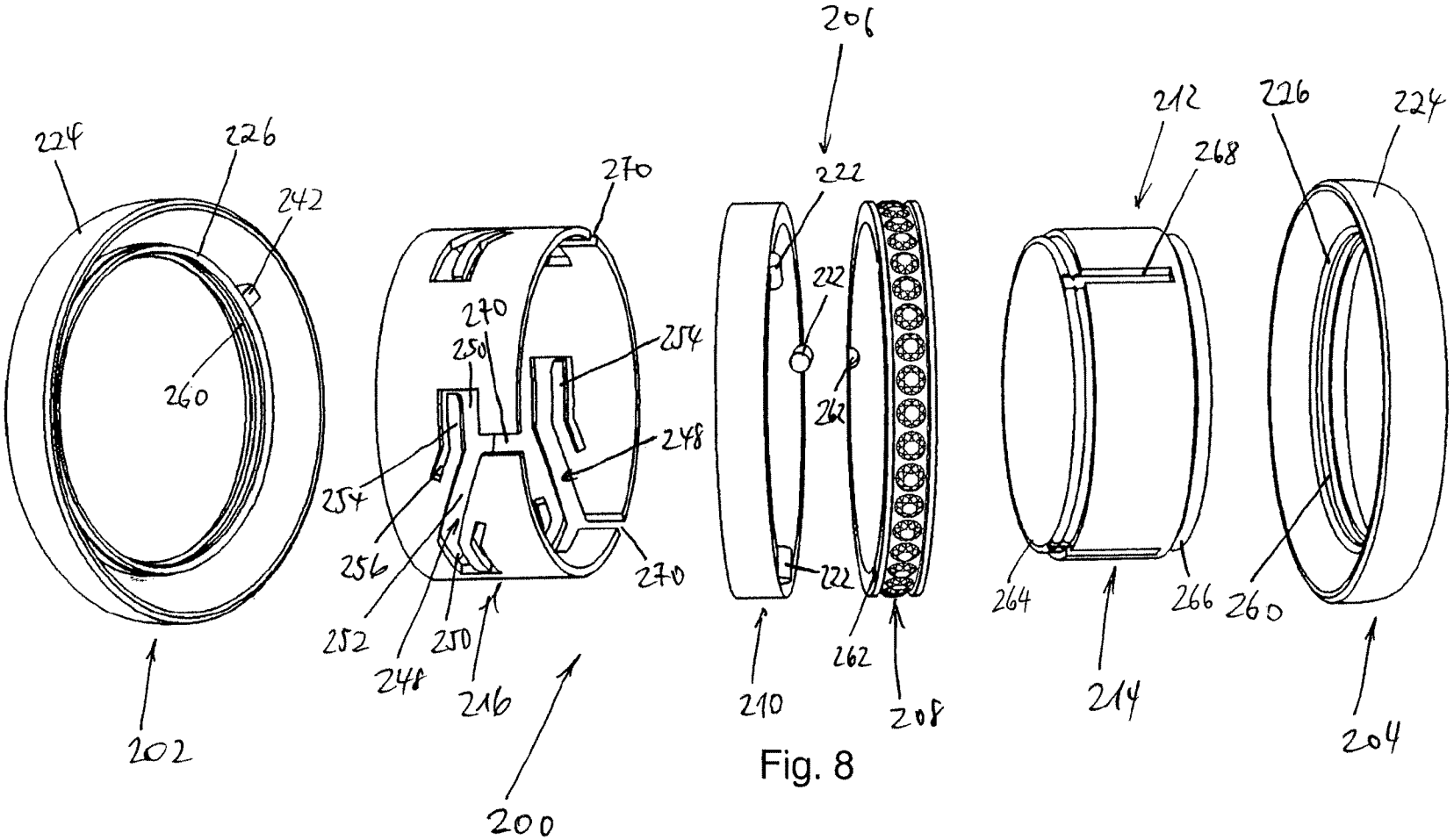
FIG. 8 shows an exploded perspective view of a second embodiment of the piece of jewelry according to the invention.
Figures 9A, 9B, 10A, 10B, 10C, 11A, 11B, 11C:
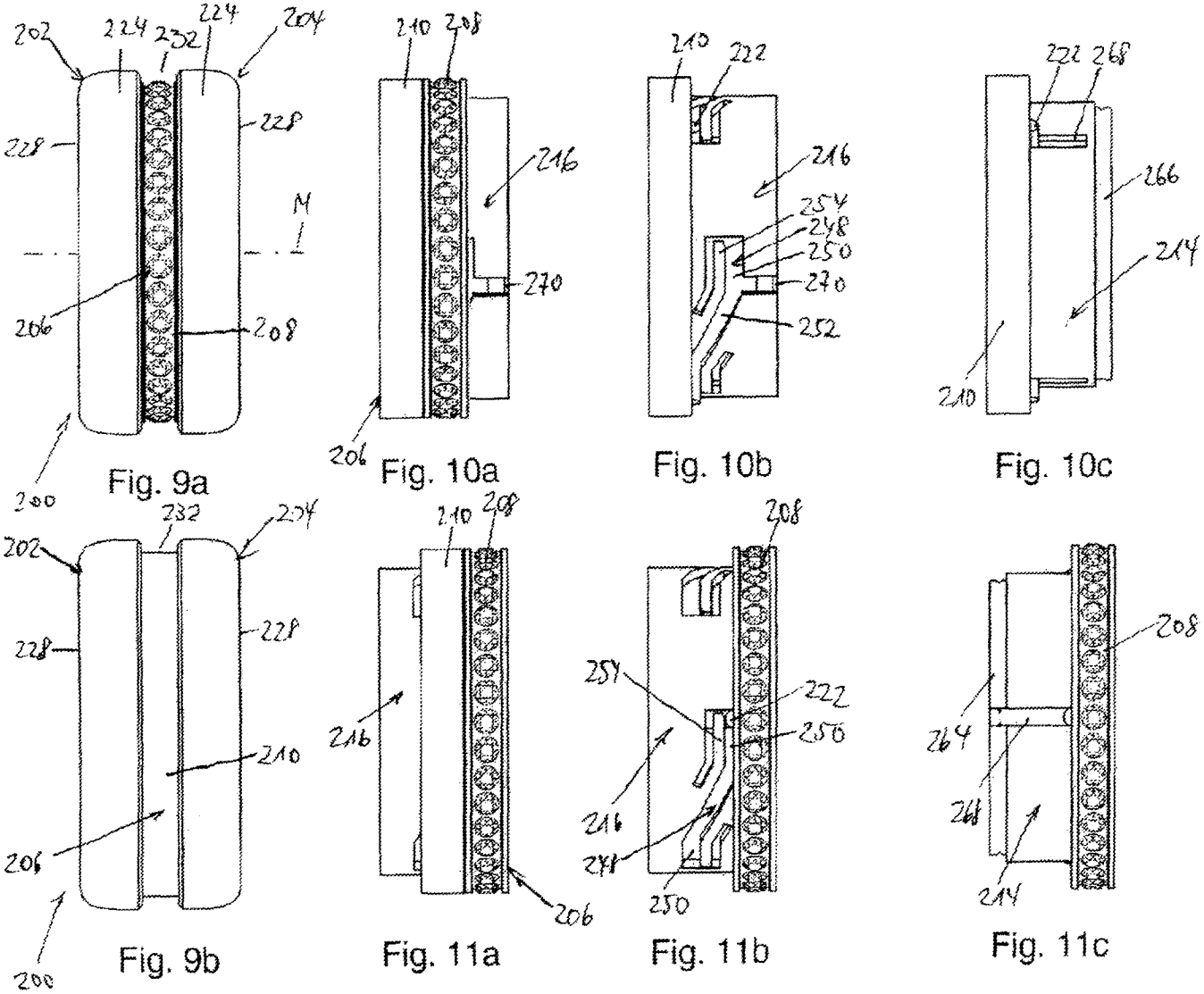
FIGS. 9*a* and 9*b* show side views of the piece of jewelry from FIG. 8 in a first and in a second position of the inner ring element.
FIGS. 10*a* to 10*c* show parts of the piece of jewelry from FIG. 8 in partially mounted state in the first position of the inner ring element.
FIGS. 11*a* to 11*c* show parts of the piece of jewelry from FIG. 8 in partially mounted state in the second position of the inner ring element.
Figure 12A:
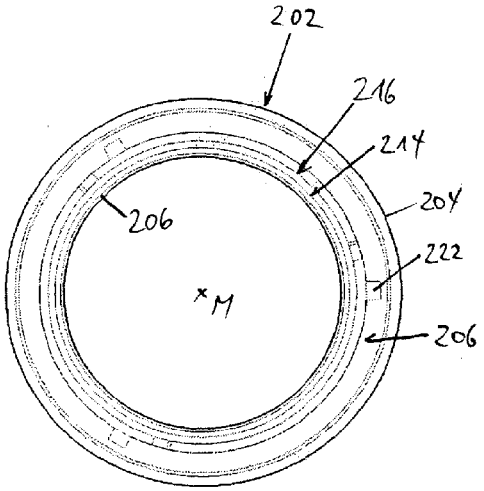
FIG. 12*a* shows a cross-sectional view of the piece of jewelry in the first position of the inner ring element.
Figure 12B:
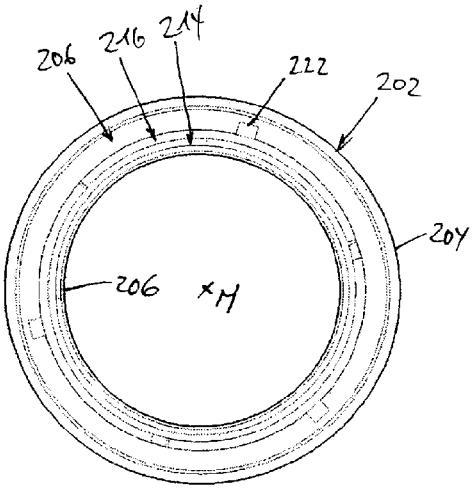
FIG. 12*b* shows a cross-sectional view of the piece of jewelry in the second position of the inner ring element.

As best seen in FIG. 8, the ring 200 depicted in FIGS. 8 to 15 essentially consists of the two outer ring elements 202, 204, the inner ring element 206 consisting of the two halves 208, 210, as well as a first and a second sleeve-like guiding element 214, 216, which respectively have a guidance for three guiding pins 222. Corresponding or functionally corresponding parts in FIGS. 8 to 15 are denoted, apart from the first digit, with the same reference sign as in FIGS. 1 to 7.

The two outer ring elements 202, 204 correspond to the before described outer ring elements 102, 104, except that for both ring elements 202, 204 the inner circumferential segments 206 are shorter than the outer circumferential segments 204, and that they comprise a circumferential snap or joining groove 260 on their inside. Here, the nose 242 projects into a slit opening (not visible) being open towards the ring element 102, of the second guiding element 216, which is connected in a rotatably fixed manner to the outer ring element 102.

The inner ring element 206 corresponds to the before described inner ring element 106, except that on the opposing front faces of the two halves 210 and 208 semi-cylindrical blind hole openings 262 are arranged in even angular distances of 120 degrees, and that in the blind hole openings 262 of the one half 210 cylindrical guiding pins 222 are fixedly installed, which project a bit over the cylindrical inside of the ring element 206. Furthermore, the ring element 206 is not fixedly connected to the radial inwards arranged guiding element 216, but is rotatable around the ring axis M in relation to guiding element 216.

Figure 13:
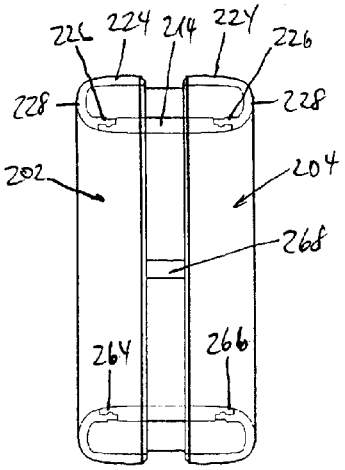
FIG. 13 shows a schematic longitudinal section view of parts of the piece of jewelry from FIG. 8.
Figure 14:
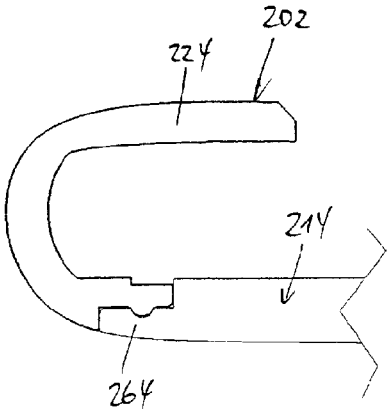
FIG. 14 shows an enlarged view of the section XIV from FIG. 13.

In this case, the tubular spacer 212 is formed by the first guiding element 214, which is inserted between the inner circumferential segments 226 of the two outer ring elements 202, 204, wherein one 226 of its tapered front faces is fixedly connected to the ring element 204 and the other one 264 is connected rotatably with the ring element 202, so that the two outer ring elements 202, 204 can be rotated against each other around the ring axis M after the assembling of the ring 200. FIGS. 13 and 14 show the snap engagement of the tapered front faces 264 and 266 of the guiding element 214 in the snap or joining grooves 260 of the inner circumferential segments 226 of the ring element 202 and 204, whereas the snap connection between the ring element 204 and the front face 266 of the guiding element 214 is fixed by laser welding or soldering (not depicted in FIG. 13). The guiding element 214 holds the two ring elements 202 and 204 together after the assembly and thus it also holds the inner ring element 206 and the two guiding elements 214 and 216 in place between the ring elements 204 and 206.

The smooth cylindrical inside of the guiding element 214 and the short circumferential segments 226 of the two ring elements 202, 204 are forming the smooth cylindrical contact surface, with which the ring 200, after putting it on the finger, contacts the finger.

The sleeve-like or hollow cylindrical guiding element 214 has on its outer circumference three in even angular spaces of 120 degrees arranged guiding grooves 268, which extend in axial direction of the guiding element 214 almost over its entire width and are open radially outwards from the tapered front face 264 to ring element 202, so that the ends of the guiding pins 222 can be inserted into the grooves 268 during the assembly of the ring 200.

The sleeve-like or hollow cylindrical second guiding element 216 has an inner diameter, which is slightly larger than the outer diameter of the first guiding element 214, so that the guiding element 216 can be slid onto guiding element 214, so that both guiding elements 214, 216 can be rotated against each other around the ring axis M. The shape and the guidance of the guiding element 216 resemble the shape and the guidance of the guiding element 116 of the ring 100, except that it neither comprises the notches 158 nor the material bridges 146 and the three slit-formed opening 248 of the guidance on the front face adjacent to ring element 204 has axial slit openings 270, through which the guiding pins 222 can be inserted into the openings 248.

At the assembly first the guiding element 216 is arranged on the circumferential segment 226 of the ring element 202 and is fixedly connected to the ring element 202. Then the two halves 208 and 210 of the ring element 206 are moved together, so that the guiding pins 222 are projecting above the inside of the ring element 206. Afterward the ring element 206 is arranged on the guiding element 216, whereby the guiding pins 222 are inserted through the slit openings 270 into the openings 248. Afterward the guiding element 214 is connected in a rotatably fixed manner to the ring element 204, before it is inserted into the guiding element 216 after adjusting the guiding pins 222 and the grooves 268 and is snapped with the ring element 202.

To arrange the inner ring element 206 between its final positions, the outer ring element 204 together with the guiding element 214 is rotated in relation to the outer ring element 202 and the guiding element 216, whereas the guiding pins 222 move alongside the openings 248 of the second guiding element 216. When the inner ends of the pins 222 pass the slanted segments 252 of the opening 248, the inner ring element 206 is moved on the first guiding element 214 in axial direction into the respective other final position. With this, the inner ring element 206 rotates in relation to the outer ring element 202, but not in relation to the outer ring element 204. In both final positions the pins 222 are again clamped by the elastic preloaded flexible latches 254, so that the inner ring element 206 cannot leave the final positions by itself.

Figure 15:
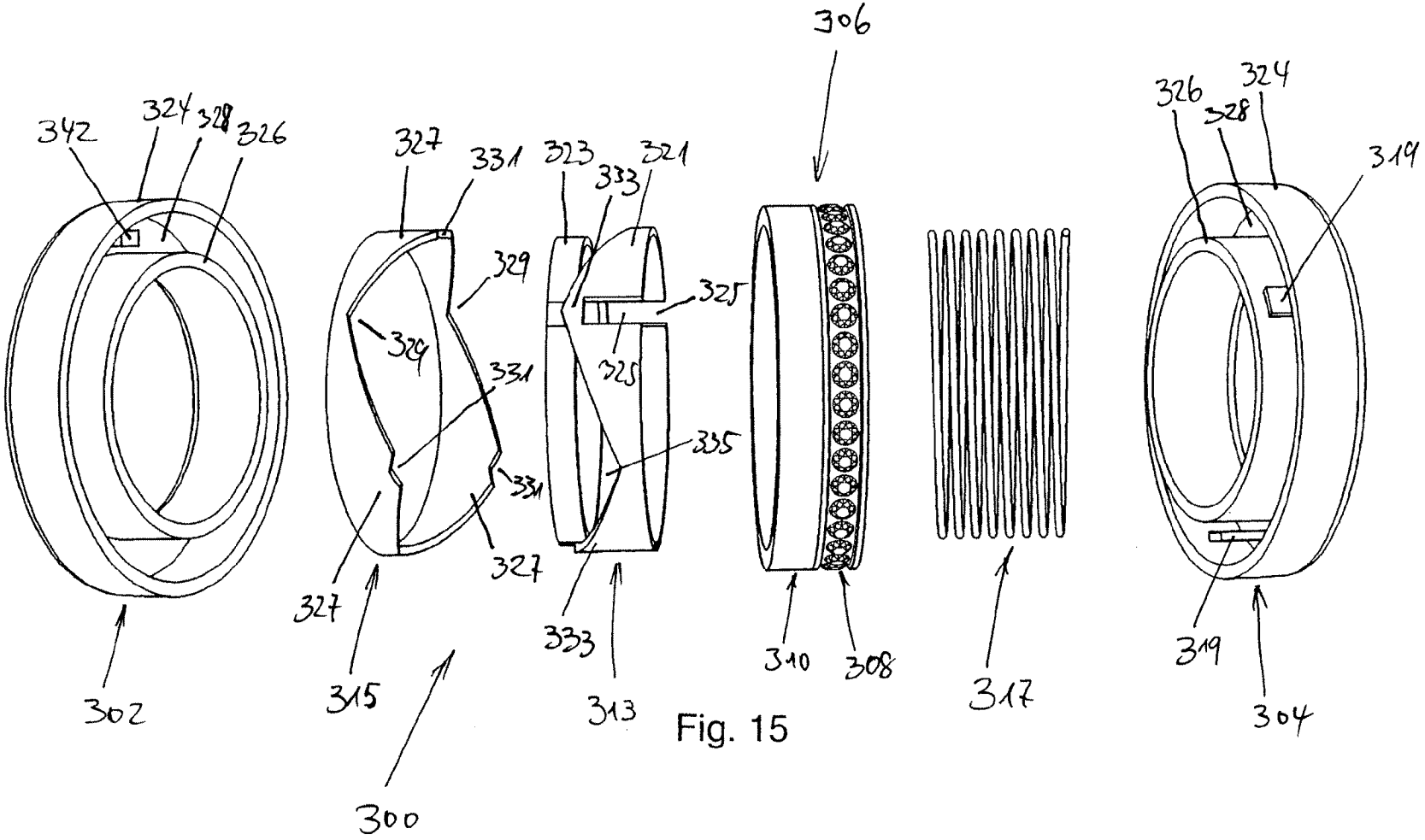
FIG. 15 shows an exploded perspective view of a third embodiment of the piece of jewelry according to the invention.

As best seen in FIG. 15, the ring depicted in FIGS. 15 to 18 consists essentially of the two outer ring elements 302, 304, the inner ring element 306 consisting of the halves 308, 310, a first and a second toothed ring element 313 or 315, which can be rotated against each other around the ring axis M, where their entire axial length changes, as well as a compression spring 317. Corresponding or functionally corresponding parts are designated in FIGS. 15 to 18, apart from the first digit 3, with the same reference signs as in FIGS. 1 to 14.

The two outer ring elements 402, 404 correspond to the before described outer ring elements 102, 104, except that in both ring elements 302, 304 the inner circumferential segments 326 are slightly longer than the outer circumferential segments 324, so that they contact in amounted state in the axial middle of the ring 300 with their opposing front faces. The nose 342 projects here in a slit opening (not visible) of the second toothed ring element 315 being open towards ring element 302, which is connected in a rotatably fixed manner to the outer ring element 302.

The inner circumferential segments 326, abutting to each other, of the two ring elements 302, 304 together form the tubular spacer 312, which provides for a constant axial length of the ring 300 and the outwards opening gap 332 between the two outer circumferential segments 324, whose width also corresponds here to the half of the width of the inner ring element 306. The two inner circumferential segments 326 are not connected on the front faces, so that the two outer ring elements 302, 304 can be rotated against each other after the assembly of the ring 300 around the ring axis M.

In contrast to the afore-described outer ring elements, the outer ring element 304 furthermore comprises three latches 319 projecting axially inwards between the circumferential segments 324 and 326, above bottom segment 328. The latches 319 serve for connecting the first toothed ring element 313 in a rotatably fixed and axially moveable manner to the ring element 304 and for centering and holding the compression spring 317, arranged between the toothed ring element 313 and the bottom segment 328 of the inner ring element 304, between the inner circumferential segment 326 of the ring element 304 and the latches 319.

The inner ring element 306 corresponds to the afore-described inner ring element 106. The ring element 306 is arranged radially inwards from ring element 306 onto the first toothed ring element 313 and is firmly connected to the toothed ring element 313.

The first toothed ring element 313 consists of two annular parts 321 and 323 with different diameters, which are fixedly connected to each other. The inner diameter and the outer diameter of the part 321 adjacent to ring element 302 correspond to the inner diameter and the outer diameter of the second toothed ring element 315 and the radial distance of the insides and outsides of the latches 319 of the ring axis M. In this way it is achieved that the latches 319 project in both final positions of the inner ring element 306 in complementary, notches 325 of the part 321 being open towards the ring element 304, as best seen in FIGS. 17*a* and 17*b*, and so they prevent rotation of the toothed ring element 313 in relation to the ring element 304. On the other hand, the opposing front faces of the two toothed ring elements 313 and 315 are pressed onto each other by the compression spring 317, which is supported by ring element 304 and contacts the part 323 of the toothed ring element 315, its inner diameter and outer diameter corresponding to the inner diameter and the outer diameter of the compression spring 317.

The part 321 of the first toothed ring element 313 has on its front face facing the toothed ring element 315 a toothed shape with three in even angle spaces arranged raisings 333 and three larger recesses 335 being arranged between the raisings 333, between which slanted flanks are arranged.

The second toothed ring element 315 has on its front face facing the first toothed ring element 315 a toothed shape with three in even angle spaces arranged raisings 327 and three larger recesses 329 being arranged between the raisings 327 between which diagonal flanks are arranged as well. The recesses 327 are provided with smaller recesses 331 on their apexes.

The toothed shape of the two toothed ring elements 313, 315 are adjusted so that in the one final position of the inner ring element 306 they lie, except in the area of the smaller recesses 331, against each other with their surfaces, as shown in FIG. 16*b*, whereas in the other final position the raisings 327 engage the smaller recesses 331 with their peaks on the apexes of the raisings 327, as shown in FIG. 17*b*.

If the two outer ring elements 302 and 304 shown in FIGS. 16*a* and 16*b* in a final position of the inner ring element 306 are rotated against each other around the ring axis M, the toothed ring element 313 is moved against the action of the compression spring 317 in direction to the ring element 304, until the peaks of the raisings 327 in the final position of the inner ring element 306 in FIGS. 17*a* and 17*b* snap into the smaller recesses 331 on the apexes of the raisings 327. Together with the toothed ring element 313 the inner ring element 306 fixedly connected to toothed ring element 313 is moved in the direction of the outer ring element 304.

If the two outer ring elements 302 and 304 shown in FIGS. 17*a* and 17*b* in the final position of the inner ring element 306 are rotated slightly around the ring axis M, until the peaks of the raisings 327 rise out of the apexes of the raisings 327, the force of the preloaded compression spring 317 pushes the ring element 306 together with toothed ring element 313 back in the final position shown in FIGS. 16*a* and 16*b*.

Both times the inner ring element 306 rotates in relation to the outer ring element 302, but not in relation to the outer ring element 304.

Figures 18, 19:
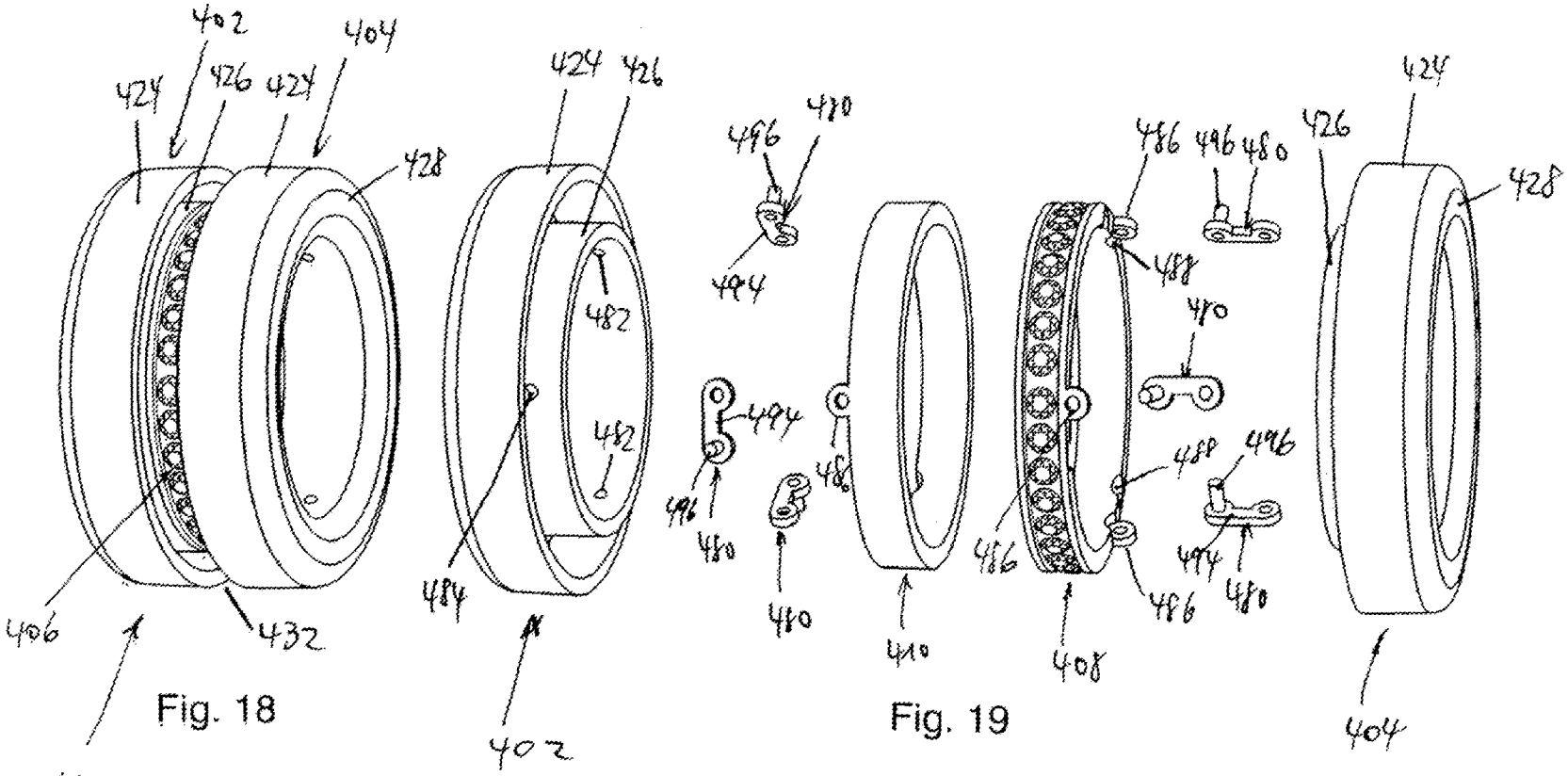
FIG. 19 shows an exploded perspective view of a fourth embodiment of the piece of jewelry according to the invention.
Figure 21A:
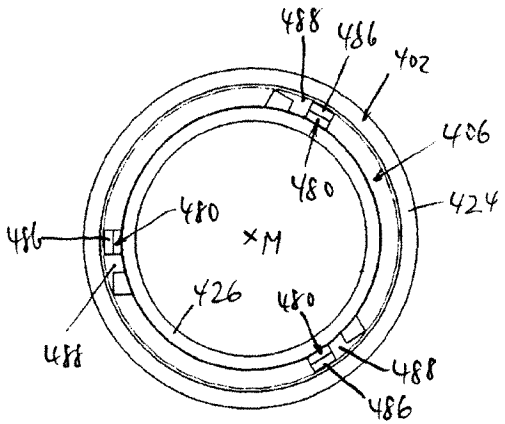
FIG. 21*a* shows a cross-sectional view of the piece of jewelry in the first position of the inner ring element.
Figure 21B:
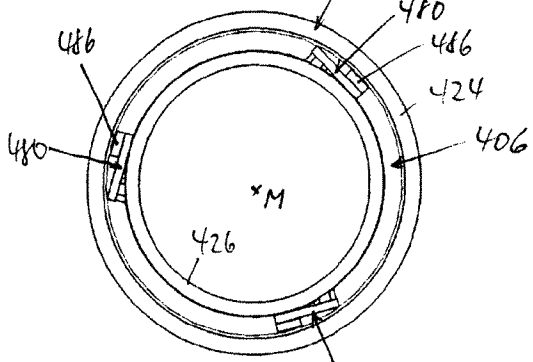
FIG. 21*b* shows a cross-sectional view of the piece of jewelry in the second position of the inner ring element.

As best seen in FIG. 19, the ring 400 shown in FIGS. 19 to 21 consists essentially of the two outer ring elements 402, 404, the inner ring element 406 consisting of the two halves 408, 410 and in total six coupling parts 480, of which three are arranged between the inner ring element 406 and outer ring elements 402, 404, respectively. Corresponding or functionally corresponding parts are designated in FIGS. 18 to 21, apart from the first digit 4, with the same reference signs as in FIGS. 1 to 17.

The two outer ring elements 402, 404 correspond to the before described outer ring elements 302, 304 with reference to FIGS. 15 to 17, except that in each of the inner circumferential segments 426 of the ring elements 402, 404 three bores 482 are provided, arranged in even angle spaces and in an axial plane, in which a radially aligned thin cylindrical pivoting bolt 484 is inserted.

The ring elements 402 and 404 lie against each other with the front faces of their inner circumferential segments 426, whereas the latter form the spacer 412 and contact the finger with their smooth cylindrical insides. Furthermore the two outer ring elements 402 and 404 are coupled by the coupling parts 480 and by the inner ring element 406 so that they can be moved around the ring axis M with a limited angle in relation to each other, whereby this rotation causes an axial movement of the inner ring element 406 between the two final positions, shown in FIGS. 20*a* and 20*b*. In both final positions of the inner ring element 406 the pivoting bolts 484 of the two ring elements 420 and 404 are shifted opposingly in circumferential direction, as best seen in FIGS. 20*a* and 20*b*.

The inner ring element 406 corresponds to the before described inner ring element 106, except that after the assembly of the ring 400 the two halves 408, 410 are movable in relation to each other around the ring axis M, so that their outer circumference surfaces have a larger radial distance from the outer circumferential segment 424 of the ring elements 402, 404, and that on the two non-facing other front faces of the two halves 408, 410, respectively, three bearing eyes 486 are provided and in circumferential direction on one side of each bearing eye 486 a small notch 488 is provided. Each bearing eye 486 is slightly thinner than the ring element 406, projects axially above the outer circumference of the ring element 406 and has a radially directed bore, which serves for insertion of a thin cylindrical pivoting bolt 492 of one of the coupling part 480. The bearing eyes 486 on both opposed front faces the ring element 406 are in circumferential direction on the same position, respectively.

The coupling part 480 each comprise a thin longitudinal plate 494 which ends are formed by two enlarged eyes. In one of the eyes a thin cylindrical pivoting bolt 496 is inserted, which can be inserted from the inside in the bore of one of the bearing eyes 486. The other eye has a bore, in which one of the pivoting bolt 484 can be inserted from the inside, which projects over the inner circumferential segments 426 of the ring elements 402, 404.

Figure 20A:
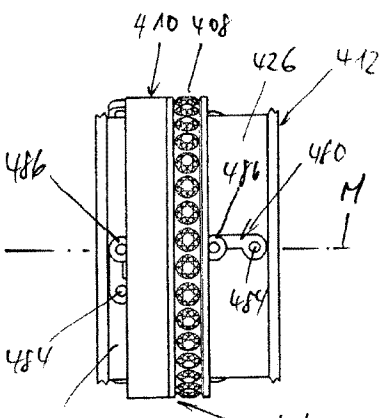
FIG. 20*a* shows parts of the piece of jewelry from FIG. 19 in the first position of the inner ring element.
Figure 20B:
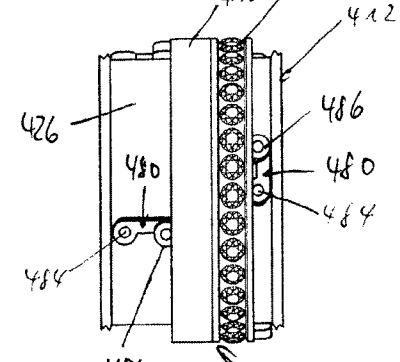
FIG. 20*b* shows parts of the piece of jewelry from FIG. 19 in the second position of the inner ring element.

After coupling the two halves 408 and 410 of the ring element 406 by means of the matching coupling part 480 with the adjacent outer ring element 402, 404 and after moving the ring element 406 into the final position shown in FIGS. 18 and 20, the coupling parts 480 contact the ring element 402 on the opposite side of the ring element 406 against the adjacent front face of the half 410, as shown in FIG. 20*a*, wherein the enlarged eye is received by each element 480 partly from one of the notches 488. In contrast thereto, the coupling part 480 are aligned axially on the side adjacent to the ring element 404 of the ring element 406.

If in this state the two outer ring elements 404 and 406 are rotated opposingly around the ring axis M, ring element 406 moves in the final position shown in FIG. 20*b*. In this final position the coupling part 480 contacts the ring element 404 on the opposed side of the ring element 406 against the adjacent front face of the half 408, as shown in FIG. 20*b*, whereby the one enlarged eye is received from each element 480 partly into one of the notches 488. The coupling part 480 on side of ring element 406 adjacent to the ring element 406 are then axially adjusted.

What is claimed is:

1. An annular piece of jewelry with a plurality of coaxial ring elements connected to each other and moveable in relation to each other, where the ring elements comprise an inner ring element and two outer ring elements and wherein the inner ring element and the outer ring elements can be moved in relation to each other into various positions, in which the outer ring elements cover different outer circumference surface regions of the inner ring element, and wherein the inner ring element is arranged in an axial direction between the two outer ring elements or between parts of the outer ring elements, wherein the two outer ring elements and the inner ring element are coupled to each other, the two outer ring elements are rotatably attached and fixed in the axial direction with respect to each other and the inner ring element moves in the axial direction due to rotation of one of the outer ring elements.

2. The annular piece of jewelry according to claim 1, wherein an inner cross section or inner diameter of the outer ring elements or of parts of the outer ring elements is smaller than an inner cross section or inner diameter of the inner ring element.

3. The annular piece of jewelry according to claim 1, wherein the inner ring element comprises of at least two parts.

4. The annular piece of jewelry according to claim 1, wherein the inner ring element is held in two axial final positions.

5. The annular piece of jewelry according to claim 1, including a spacer which is arranged radially inwards from the inner ring element, the spacer holding the two outer ring elements in a predefined axial position.

6. The annular piece of jewelry according to claim 5, wherein an inner side of the spacer forms a contact surface for a body part.

7. The annular piece of jewelry according to claim 6, wherein the contact surface is a smooth, generally cylindrical contact surface.

8. The annular piece of jewelry according to claim 5, wherein the spacer is formed by either at least one inner circumferential surface region of the two outer ring elements or the spacer is formed as a separate element inserted in between the at least one inner circumferential surface region of the two outer ring elements.

9. The annular piece of jewelry according to claim 6, wherein the spacer is formed by either at least one inner circumferential surface region of the two outer ring elements or the spacer is formed as a separate element inserted in between the at least one inner circumferential surface region of the two outer ring elements.

10. The annular piece of jewelry according to claim 7, wherein the spacer is formed by either at least one inner circumferential surface region of the two outer ring elements or the spacer is formed as a separate element inserted in between the at least one inner circumferential surface region of the two outer ring elements.

11. The annular piece of jewelry according to claim 1, wherein the inner ring element is in relation to one of the two outer ring elements axially moveable and non-rotatable and in relation to the other one of the two outer ring elements axially moveable and rotatable.

12. The annular piece of jewelry according to claim 1, wherein at least one annular or sleeve-like guiding element with a guidance is arranged in radial direction inwards from the inner ring element.

13. The annular piece of jewelry according to claim 12, wherein the at least one annular or sleeve-like guiding element includes two annular or sleeve-like guiding elements having different guidances.

14. The annular piece of jewelry according to claim 1, including a toothed ring element arranged in radial direction inwards from the inner ring element which engages an opposing toothed ring element and which can be moved by a rotation of the two outer ring elements together with the inner ring element.

15. The annular piece of jewelry according to claim 14, including a spring, which counteracts the movement of the toothed ring element in one direction.

16. The annular piece of jewelry according to claim 1, wherein the inner ring element is connected to the outer ring elements by a pivotable coupling part, which during a movement of the inner ring element in relation to the outer ring elements are pivoted in relation to the inner ring element as well as in relation to the outer ring elements.

* * * * *